US009514759B2

(12) United States Patent
Virette et al.

(10) Patent No.: US 9,514,759 B2
(45) Date of Patent: Dec. 6, 2016

(54) METHOD AND APPARATUS FOR PERFORMING AN ADAPTIVE DOWN- AND UP-MIXING OF A MULTI-CHANNEL AUDIO SIGNAL

(71) Applicant: Huawei Technologies Co., Ltd., Shenzhen, Guangdong (CN)

(72) Inventors: David Virette, Munich (DE); Janusz Klejsa, Stockholm (SE); Willem Bastiaan Kleijn, Lower Hutt (NZ)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/460,074

(22) Filed: Aug. 14, 2014

(65) Prior Publication Data

US 2014/0355767 A1 Dec. 4, 2014

Related U.S. Application Data

(63) Continuation of application No. PCT/EP2012/052443, filed on Feb. 14, 2012.

(51) Int. Cl.
*G10L 19/008* (2013.01)

(52) U.S. Cl.
CPC ..... *G10L 19/008* (2013.01)

(58) Field of Classification Search
CPC ..... H04S 3/02; H04S 3/00; H04S 3/008; H04S 3/006; H04S 2400/03; G10L 19/008; G10L 19/0212; G10L 19/20; G10L 19/24; G10L 19/22
USPC ..... 381/17–23, 119; 704/500, 501
See application file for complete search history.

(56) References Cited

U.S. PATENT DOCUMENTS

| | | | | |
|---|---|---|---|---|
| 5,594,800 | A * | 1/1997 | Gerzon | 381/20 |
| 7,787,631 | B2 * | 8/2010 | Faller | H04S 3/008 381/17 |
| 8,346,564 | B2 * | 1/2013 | Hotho et al. | 704/500 |
| 8,515,759 | B2 * | 8/2013 | Engdegard et al. | 704/258 |
| 8,654,985 | B2 * | 2/2014 | Villemoes et al. | 381/22 |

(Continued)

FOREIGN PATENT DOCUMENTS

| | | | |
|---|---|---|---|
| CN | 1938760 | A | 3/2007 |
| EP | 1853092 | A1 | 11/2007 |

(Continued)

OTHER PUBLICATIONS

Yang et al., "Adaptive Karhunen-Loeve Transform for Enhanced Multichannel Audio Coding," Proceedings of the SPIE, vol. 4475, pp. 43-54, The International Society for Optical Engineering, Bellingham, Washington (Dec. 5, 2001).

(Continued)

*Primary Examiner* — Vivian Chin
*Assistant Examiner* — Jason R Kurr
(74) *Attorney, Agent, or Firm* — Leydig, Voit & Mayer, Ltd.

(57) ABSTRACT

A method and apparatus for performing an adaptive down-mixing of a multichannel audio signal comprising a number of input channels, wherein a signal adaptive transformation of said input channels is performed by multiplying the input channels with a downmix block matrix comprising a fixed block for providing a set of backward compatible primary channels and a signal adaptive block for providing a set of secondary channels.

20 Claims, 8 Drawing Sheets

(56) References Cited

U.S. PATENT DOCUMENTS

| | | | | |
|---|---|---|---|---|
| 2007/0233293 | A1 | 10/2007 | Villemoes et al. | |
| 2010/0324915 | A1 | 12/2010 | Seo et al. | |
| 2012/0269353 | A1* | 10/2012 | Herre | G10L 19/008 381/22 |
| 2014/0233762 | A1* | 8/2014 | Vilkamo | G10H 1/183 381/119 |

FOREIGN PATENT DOCUMENTS

| | | | |
|---|---|---|---|
| JP | 2002241524 | A | 12/2002 |
| JP | 2002541524 | A | 12/2002 |
| JP | 2011008258 | A | 1/2011 |
| KR | 20080103094 | A | 11/2008 |
| WO | 0060746 | A2 | 10/2000 |
| WO | 2005098824 | A1 | 10/2005 |

OTHER PUBLICATIONS

Yang et al., "High-Fidelity Multichannel Audio Coding with Karhunen-Loeve Transform," IEEE Transactions on Speech and Audio Processing, vol. 11, No. 4, pp. 365-380, Institute of Electrical and Electronics Engineers, New York, New York (Jul. 2003).

Hotho et al., "A Backward-Compatible Multichannel Audio Codec," IEEE Transactions on Audio, Speech, and Language Processing, vol. 16, No. 1, pp. 83-93, Institute of Electrical and Electronics Engineers, New York, New York (Jan. 2008).

Derrien et al., "A New Model-Based Algorithm for Optimizing the MPEG-AAC in MS-Stereo," IEEE Transactions on Audio, Speech, and Language Processing, vol. 16, No. 8, pp. 1373-1382, Institute of Electrical and Electronics Engineers, New York, New York (Nov. 2008).

Torres-Guijarro et al., "Inter-channel de-correlation for perceptual audio coding," Applied Acoustics, vol. 66, pp. 889-901, Elsevier, Amsterdam, Netherlands (2005).

Briand et al., "Parametric Coding of Stereo Audio Based on Principal Component Analysis," Proceedings of the 9$^{th}$ International Conference on Digital Audio Effects (DAFx-06), Montreal, Canada (Sep. 18-20, 2006).

Briand et al., "Parametric Representation of Multichannel Audio Based on Principal Component Analysis," Presented at the 120$^{th}$ AES Convention, Paris France, Journal of the Audio Engineering Society, pp. 1-13, New York, New York (May 20-23, 2006).

Johnston, "Perceptual Transform Coding of Wideband Stereo Signals," 1989 International Conference on Acoustics, Speech, and Signal Processing, vol. 3, pp. 1993-1996, Institute of Electrical and Electronics Engineers, New York, New York (May 23-26, 1989).

Yang et al., "Progressive Syntax-Rich Coding of Multichannel Audio Sources," EURASIP Journal on Applied Signal Processing, vol. 10, pp. 980-992, Hindawi Publishing Corporation, Cairo, Egypt (2003).

* cited by examiner

METHOD AND APPARATUS FOR PERFORMING AN ADAPTIVE DOWN- AND UP-MIXING OF A MULTI-CHANNEL AUDIO SIGNAL

CROSS-REFERENCE TO RELATED APPLICATION

This application is a continuation of International Patent Application No. PCT/EP2012/052443, filed Feb. 14, 2012, which is hereby incorporated by reference in its entirety.

TECHNICAL BACKGROUND

The present disclosure relates to a method for performing an adaptive down-mixing and following up-mixing of a multi-channel audio signal. In particular, the method is related to down-mixing and up-mixing operations that are commonly used in multi-channel audio coding or spatial audio coding.

Conventional adaptive down-mixing methods use a down-mixing transformation that is signal-dependent. Depending on the particular realization of the signal the most efficient down-mixing transformation is selected from a set of available down-mixing transformations. For example, in the case of stereo coding the down-mixing transformation of the stereo coding scheme can be selected, from a set comprising two different down-mixing transformations comprising an identity transformation (so-called LR coding) and a transformation yielding a sum (so-called M/Mid-channel) and a difference of the input channels (so-called S/Side-channel).

Such a conventional coding scheme is typically referred to as M/S coding or Mid/Side coding. Further such a conventional M/S coding provides only a limited rate distortion gain since the set of available transforms is limited. Moreover, since a closed loop coding is used, the associated complexity can be large.

These drawbacks of M/S coding have been addressed by down-mixing methods where the down-mixing transformation is computed based on an interchannel covariance matrix as described in M. Briand, D. Virette and N. Martin "Parametric Coding of Stereo Audio Based on Principal Component Analysis", Proc. of the 9$^{th}$ International Conference on Digital Audio Effects, Montreal, Canada, Sep. 28, 2006. Further, this approach is limited to a stereo signal and cannot be adapted to a larger number of input channels. An extension of this approach to a higher number of channels is described in D. Yang, H. Ai, C. Kyriakakis, and C.-C. J. Kuo, "Progressive Syntax-Rich Coding of Multichannel Audio Sources," EURASIP Journal on Applied Signal Processing, vol. 2003, pp. 980-992, January 2003. But this approach does not allow generating a backward compatible downmix.

Another disadvantage associated with the usage of a fixed set of down-mixing transformations is the difficulty in finding a suitable set of down-mixing transformations for the general case. A further conventional down-mixing transformation has been proposed in G. Hotho, L. F. Villemoes and J. Breebaart "A Backward-Compatible Multichannel Audio Codec" IEEE Transactions on Audio, Speech and Language Processing, Vol. 16, No. 1, pp. 83 to 93, January 2008. This conventional method achieves a backward compatibility by combining a matrix down-mixing transformation with prediction of the secondary channels from the primary channels. This results in a parametric coding scheme where the parameters are prediction parameters. However, this conventional approach as described by Hotho et al. is only efficient when the number of channels is low. In addition, the coding performance of this conventional down-mixing approach is suboptimal in terms of rate distortion performance.

Conventional adaptive down-mixing methods either support an arbitrary number of channels but do not preserve the spatial characteristics of the original multi-channel audio signal, which means that the backward compatibility cannot be achieved, or they preserve the spatial characteristics of the original multi-channel audio signal in the generated down-mix but can only be used for multi-channel audio signals with a limited number of audio channels. Consequently, there is a need for a method and apparatus for performing an adaptive down-mixing of a multi-channel audio signal which allows preserving the spatial characteristics of the original multi-channel audio signal and which at the same time offer a backward compatibility.

SUMMARY OF THE INVENTION

According to a first implementation of a first aspect of the present disclosure a method is provided for performing an adaptive down-mixing of a multi-channel audio signal comprising a number of input channels, wherein a signal adaptive transformation of the input channels is performed by multiplying the input channels with a downmix block matrix comprising a fixed block for providing a set of backward compatible primary channels and a signal adaptive block for providing a set of secondary channels.

In a second possible implementation of the first implementation of the first aspect of the present disclosure a signal adaptive block of the downmix block matrix is adapted depending on an interchannel covariance of the input channels.

In a further possible third implementation of the second implementation of the method according to the first aspect of the present disclosure an auxiliary covariance matrix for the interchannel covariance of the input channels is calculated by means of an auxiliary orthonormal transform.

In a further possible fourth implementation of the third implementation of the method according to the first aspect of the present disclosure said auxiliary orthonormal transform is calculated on the basis of the fixed block as initialization of a Gram-Schmidt procedure.

In a further possible fifth implementation of the third implementation of the method according to the first aspect of the present disclosure a Karhunen-Loeve-transformation matrix is calculated for a block of the auxiliary covariance matrix.

In a further possible sixth implementation of the fifth implementation of the method according to the first aspect of the present disclosure the signal adaptive block of the downmix block matrix is calculated on the basis of the calculated Karhunen-Loeve-transformation matrix.

In a further possible seventh implementation of the first to sixth implementation of the method according to the first aspect of the present disclosure the backward compatible primary channels are encoded by a single legacy encoder to generate a backward compatible primary legacy bit stream.

In a further possible eighth implementation of the method according to the first aspect of the present disclosure each backward compatible primary channel is encoded by a legacy encoder to generate a backward compatible primary legacy bit stream.

According to a possible ninth implementation of the seventh or eighth implementation of the method according to the first aspect of the present disclosure each secondary channel is encoded by a corresponding secondary channel encoder.

In a further possible tenth implementation of the seventh or eighth implementation of the method according to the first aspect of the present disclosure the secondary channels are encoded by a common multi-channel encoder to generate a secondary bit stream for the respective secondary channel.

According to a possible eleventh implementation of the third implementation of the method according to the first aspect of the present disclosure the interchannel covariance matrix or an auxiliary covariance matrix are quantized and transmitted with the secondary channel bit stream.

In a further possible twelfth implementation of the ninth or tenth implementation of the method according to the first aspect of the present disclosure the primary bit streams are transmitted along with the secondary bit streams to remote decoders.

In a further possible thirteenth implementation of the twelfth implementation of the method according to the first aspect of the present disclosure the remote decoders comprise a single legacy decoder adapted to decode the backward compatible primary bit streams for reconstructing the primary channels.

In a further fourteenth implementation of the twelfth implementation of the method according to the first aspect of the present disclosure the remote decoders comprise a corresponding number of legacy decoders adapted to decode the backward compatible primary bit streams for reconstructing the primary channels.

In a further possible fifteenth implementation of the twelfth implementation of the method according to the first aspect of the present disclosure the remote decoders comprise secondary channel decoders are adapted to decode the secondary bit streams for reconstructing the secondary channels.

In a further possible sixteenth implementation of the twelfth to fifteenth implementation of the method according to the first aspect of the present disclosure a type of a bit stream is signalled to the remote decoders.

In a further possible seventeenth implementation of the sixteenth implementation of the method according to the first aspect of the present disclosure the signalling of the type is performed by implicit signalling by means of auxiliary data transported in at least one bit stream.

In a further possible eighteenth implementation of the sixteenth implementation of the method according to the first aspect of the present disclosure the signalling of the type is performed by explicit signalling by means of a flag indicating the type of the respective bit stream.

In a further possible nineteenth implementation of the method according to the first aspect of the present disclosure the signal adaptive transformation of the number of input channels is performed by multiplying the input channels with the downmix block matrix to provide a set of backward compatible primary channels and a set of auxiliary channels.

In a further possible twentieth implementation of the nineteenth implementation of the method according to the first aspect of the present disclosure the Karhunen-Loeve-transformation KLT is applied to the set of auxiliary channels to provide the set of secondary channels.

According to a second aspect of the present disclosure a method for performing an adaptive up-mixing of received bit streams is provided, wherein a backward compatible primary bit stream is decoded by a legacy decoder to reconstruct a corresponding primary channel, and wherein a secondary bit stream is decoded by a secondary channel decoder to reconstruct a corresponding secondary channel, wherein a signal adaptive inverse transformation of the decoder bitstreams is performed by means of an upmix block matrix to reconstruct a multi-channel audio signal comprising a number of output channels.

In a first possible implementation of the second aspect of the present disclosure a signal adaptive block of the upmix block matrix is adapted depending on a decoded interchannel covariance of the input channels.

In a further possible second implementation of the first implementation of the method according to the second aspect of the present disclosure an auxiliary covariance matrix for the interchannel covariance of the input channels is decoded.

In a further possible third implementation of the second implementation of the method according to the second aspect of the present disclosure an auxiliary orthonormal inverse transform is calculated on the basis of the fixed block as initialization of a Gram-Schmidt procedure.

In a further possible fourth implementation of the second implementation of the method according to the second aspect of the present disclosure a Karhunen-Loeve-transformation matrix is calculated for a block of the auxiliary covariance matrix.

In a possible fifth implementation of the fourth implementation of the method according to the second aspect of the present disclosure the signal adaptive block of the upmix block matrix is calculated on the basis of the calculated Karhunen-Loeve-transformation matrix.

According to a third aspect of the present disclosure a down-mixing apparatus is provided adapted to perform an adaptive down-mixing of a multi-channel audio signal comprising a number of input channels, said down-mixing apparatus comprising:

a signal adaptive transformation unit which is adapted to perform a signal adaptive transformation of said input channels by multiplying the input channels with a downmix block matrix comprising a fixed block to provide a set of backward compatible primary channels and comprising a signal adaptive block to provide a set of secondary channels.

Possible implementations of the apparatus according to the third aspect are adapted to perform one, some or all of the implementations according to the first aspect.

According to a fourth aspect of the present disclosure an encoding apparatus is provided comprising a down-mixing apparatus according to the third aspect of the present disclosure and comprising further at least one legacy encoder adapted to encode the backward compatible primary channels to generate at least one backward compatible primary bit stream and comprising at least one secondary channel encoder adapted to encode the secondary channels to generate at least one secondary bit stream.

According to a fifth aspect of the present disclosure an up-mixing apparatus is provided adapted to perform an adaptive up-mixing of decoded bit streams comprising decoded primary bit streams and decoded secondary bit streams, said up-mixing apparatus comprising a signal adaptive retransformation unit which is adapted to perform a signal adaptive inverse transformation of the decoded bit streams by multiplying the decoded bit streams with an upmix block matrix comprising a fixed block for the decoded primary bit streams and a signal adaptive block for the decoded secondary bit streams.

According to a sixth aspect of the present disclosure a decoding apparatus is provided comprising an up-mixing apparatus according to the fifth aspect of the present disclosure and further comprising at least one legacy decoder adapted to decode at least one received backward compatible primary bit stream to generate at least one decoded primary bit stream supplied to said up-mixing apparatus and comprising at least one secondary channel decoder adapted to decode at least one received secondary bit stream to generate at least one decoded secondary bit stream supplied to said up-mixing apparatus.

Possible implementations of the apparatus according to the sixth aspect are adapted to perform one, some or all of the implementations according to the second aspect.

According to a seventh aspect of the present disclosure an audio system is provided comprising at least one encoding apparatus according to the fourth aspect of the present disclosure and at least one decoding apparatus according to the sixth aspect of the present disclosure, wherein said encoding apparatus and said decoding apparatus are connected to each other via a network.

According to an eighth aspect of the disclosure a computer program is provided comprising a program code for performing the method according to any of the above method aspects or their implementations, when the computer program runs on a computer, a processor, a micro controller or any other programmable device.

The aforementioned aspects and their implementations can be implemented in hardware, software or in any combination of hardware and software.

BRIEF DESCRIPTION OF FIGURES

In the following possible implementations of different aspects of the present disclosure are described with reference to the enclosed figures in more detail.

DETAILED DESCRIPTION OF EMBODIMENTS

Figure 1:
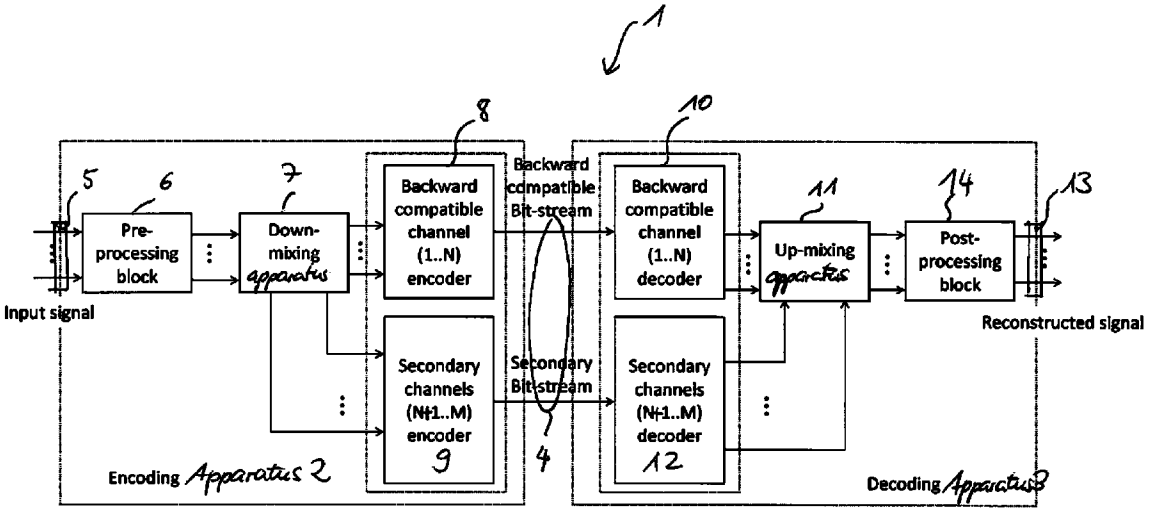
FIG. 1 shows a block diagram for a possible implementation of an audio system according to the seventh aspect of the present disclosure comprising at least one encoder apparatus and at least one decoder apparatus according to a fourth and sixth aspect of the present disclosure.

As can be seen in FIG. 1 an audio system 1 according to an aspect of the present disclosure can comprise in the shown implementation at least one encoding apparatus 2 and at least one decoding apparatus 3 which can be connected via a network or a signal line 4. In the shown implementation of FIG. 1 the encoding apparatus 2 can comprise the signal input 5 to which a multi-channel audio signal can be applied. This multi-channel audio signal can comprise a number M of input channels. In the shown exemplary implementation of FIG. 1 the input multi-channel audio signal is applied to a pre-processing block 6 adapted to pre-process the received multi-channel audio signal. The pre-processing block 6 can in a possible embodiment perform a delay alignment between the input channels of the received multi-channel audio signal and/or a time frequency transformation of the input channels. The pre-processed multi-channel audio signal is supplied by the pre-processing block 6 to a down-mixing apparatus 7 which is adapted or configured to perform an adaptive down-mixing of the received pre-processed multi-channel audio signal. In an alternative embodiment the multi-channel audio signal comprising the number M of input channels is directly applied to the down-mixing apparatus 7 without performing any pre-processing. In case of time frequency transformation, the down-mixing apparatus 7 and the up-mixing apparatus 11 as shown in FIG. 1 are provided separately for each sub-band of the input multi-channel audio signal. The sub-band can be defined as a band-limited audio signal which can be represented by spectral coefficients or a decimated time domain audio signal. A sub-band processing offers advantages in terms of performance as the down-mixing block and up-mixing block are performed on a band limited signal corresponding to a limited frequency band.

The down-mixing apparatus 7 comprises a signal adaptive transformation unit which is adapted to perform a signal adaptive transformation of the received input channels of the multi-channel audio signal by multiplying the input channels with a downmix block matrix comprising a fixed block to provide a set of backward compatible primary channels and comprising a signal adaptive block to provide a set of secondary channels. The down-mixing operation performed by the down-mixing apparatus 7 can yield M channels in the down-mix domain comprising two groups, i.e. a first group of N backward compatible primary channels and a group of M-N secondary channels, where $1 \leq N \leq M$ and $3 \leq M$. Typically, the provided backward compatible primary channels comprise a larger energy than the secondary channels. This can be a result of the energy concentration achieved by the down-mixing method employed by the down-mixing apparatus 7.

As can be seen in FIG. 1 the encoding apparatus 2 further comprises one legacy encoder 8 to encode N backward compatible channels or alternatively N backward compatible channel encoders or legacy encoders 8, wherein each backward compatible primary channel is encoded by a corresponding legacy encoder 8 to generate a backward compatible primary legacy bit stream which can be transported via the data network 4 to the decoding apparatus 3 as illustrated in FIG. 1. The encoding apparatus 2 further comprises (M-N) secondary channel encoders 9. Each secondary channel output by the down-mixing apparatus 7 is encoded by a corresponding secondary channel encoder 9 to generate a corresponding secondary bit stream which is transported via the data network 4 to the decoding apparatus 3. In an alternative embodiment all secondary channels can be encoded by a common multi-channel encoder 9 to generate a secondary bit stream for each secondary channel. The generated primary bit streams and secondary bit streams are transmitted via signal lines or a data network 4 to the remote decoding apparatus 3 as shown in FIG. 1. In addition to the secondary channel an estimate of the interchannel covariance matrix or the auxiliary covariance matrix can be quantized and transmitted.

The backward compatible primary channels are encoded by a single legacy encoder 8 as shown in FIG. 1 or alternatively by N backward compatibly channel encoders at high fidelity for providing a backward compatibility with corresponding legacy decoders. The secondary channels are encoded by the secondary channel encoders 9, wherein usually parametric spatial audio coding is used. It is also possible in a specific implementation that the secondary channels are dropped within the audio system 1. In a possible embodiment the secondary channels can be ranked by a level of importance. Depending on an available bit rate the encoder apparatus 2 may decide to drop some of the less important secondary channels.

In a possible scenario the backward compatible primary channels of the downmix signal can facilitate a playout using only the N primary channels which is also called legacy playout. In this situation the backward compatible primary channels do preserve some spatial properties of the original M input channels of the multi-channel audio signal in order to render a perceptually meaningful reconstruction using the legacy N channel playout.

As can be seen in FIG. 1 the audio system 1 comprises at least one decoding apparatus 3 which receives the backward compatible primary bit streams and the secondary bit streams via the data network 4. The decoding apparatus 3 according to a sixth aspect of the present disclosure comprises N legacy decoders 10 which decode the received backward compatible primary bit streams to generate decoded primary bit streams which are supplied to an up-mixing apparatus 11 of the decoding apparatus 3. The decoding apparatus 3 can comprise M-N secondary channel decoders 12 adapted to decode the received secondary bit streams to generate decoded secondary bit streams supplied to the up-mixing apparatus 11 or alternatively only one secondary channel decoder 12 to decode the M-N secondary bit streams as illustrated in FIG. 1. The up-mixing apparatus 11 is adapted to perform an adaptive up-mixing of decoded bit streams. The up-mixing apparatus 11 can comprise a signal adaptive retransformation unit which is adapted to perform a signal adaptive inverse transformation of the decoded bit streams by multiplying the decoded bit streams with an upmix block matrix comprising a fixed block for the decoded primary bit streams and a signal adaptive block for the decoded secondary bit streams. The output signals of the up-mixing apparatus 11 are supplied in the shown implementation of FIG. 1 to a post-processing block 14, where a post-processing of the up-mixed signal can be performed such as including a time frequency inverse transformation and/or synthesizing a delay for the respective output signals. The decoding apparatus 3 comprises a signal output 13 for outputting the reconstructed signals.

As can be seen in FIG. 1 the backward compatible primary bit streams and the secondary bit streams are transported via a data transport medium or a data network 4. This data network 4 can be formed by an IP network. In a possible implementation the bit streams can be transported in the same packet or separate data packets.

In a possible implementation each bit stream can comprise an indication of the type of the respective bit stream. A possible type for a bit stream is an MP3 bit stream according to the standard ISO/IEC 11172-3. Alternative types for bit streams are advanced audio coding (AAC) bit streams as defined in the standard ISO/IEC 14496-3, or OPUS bit streams. The primary backward compatible bit stream can be one of these legacy types. MP3 and AAC are widely deployed and an existing legacy decoder can decode the backward compatible primary bit stream. The secondary bit stream can also be of a legacy type but also of a future or application individual type.

In a possible implementation the type of the respective bit stream is signalled to the remote decoders 10, 12 of the decoding apparatus 3. In a possible embodiment the signalling of the type is performed by an implicit signalling by means of auxiliary data transported in at least one bit stream. In an alternative embodiment the signalling is performed by explicit signalling by means of a flag indicating the type of the respective bit stream. In a possible embodiment it is possible to switch between a first signalling option comprising implicit signalling and a second signalling option comprising explicit signalling. In a possible implementation of the implicit signalling a flag can indicate a presence of the secondary channel information in auxiliary data of at least one backward compatible primary bit stream. The legacy decoder 10 does not check whether a flag is present or not and does only decode the backward compatible primary channel. For instance, the signalling of the secondary channel bit stream may be included in the auxiliary data of an AAC bit stream. Moreover, the secondary bit stream may also be included in the auxiliary data of an AAC bit stream. In that case, a legacy AAC decoder decodes only the backward compatible part of the bit stream and discards the auxiliary data. A not legacy type decoder according to an implementation of the present disclosure can check the presence of such a flag and if the flag is present in the received bit stream the not legacy decoder does reconstruct the multi-channel audio signal.

In a possible implementation of the explicit signalling a flag indicating that the bit stream is a secondary bit stream according to an implementation of the present disclosure obtained with a not legacy type secondary channel encoder 9 according to an implementation of the present disclosure can be used. A legacy decoder of the decoding apparatus 3 is not able to decode the bit stream as it does not know how to interpret this flag. However, a decoder according to an implementation of the present disclosure can have the ability to decode and can decide to decode either the backward compatible part only or the complete multi-channel audio signal.

A benefit of such a backward compatibility can be seen as follows. A mobile terminal according to an implementation of the present disclosure can decide to decode the backward compatible part to save the battery life of an integrated battery as the complexity load is lower. Moreover, depending on the rendering system, the decoder can decide which part of the bit stream to decode. For example, for rendering with a headphone, the backward compatible part of the received signal can be sufficient, while the multi-channel audio signal is decoded only when the terminal is connected for example to a docking station with a multi-channel rendering capability.

A main advantage provided by the backward compatibility provided by the audio system 1 according to the present disclosure is the possibility to decode directly the backward compatible part on a legacy decoder 10 which would not have the ability to render the multi-channel audio signal. Moreover, conventional equipment in which only a legacy decoder 10 is integrated may decode directly the backward compatible audio signal without the need to perform a transcoding operation from one coding format to another coding format. This facilitates the deployment of a new coding format and reduces the complexity for providing backward compatibility.

The backward compatible primary channels are generated in a backward compatible fashion. This means that the primary channels can be encoded using a conventional legacy audio encoder 8. For example, an existing stereo encoder can be used to encode stereo primary channels of the backward compatible downmix. Bit streams describing the backward compatible primary channels can be separated from the bit streams that render the reconstruction of the original multi-channel audio signal. For example, the multi-channel audio signal can be reconstructed by the conventional audio decoder 10 by stripping off bits from the complete bit stream. The reconstructed primary channels can be played out using a lower number of channels than the original number M of input channels. For example, a five channel signal can be played out using stereo loudspeakers.

A practical implication of the backward compatibility of the down-mixing transformation approach used by the method according to the present disclosure is that the backward compatible primary channels are generated in a restricted way. This restriction is due to the properties of the legacy encoders 8 and due to the requirement on particular composition of the backward compatible primary channels obtained by combining the channels of the original multi-channel signal.

In a possible embodiment the backward compatible primary channels can be encoded with an audio encoder (mono, stereo or multi-channel) which does provide a legacy primary bit stream for the N primary channels of the backward compatible downmix. The secondary channel encoder 9 generates another part of the bit stream which can be used by the decoding apparatus 3 to reconstruct the multi-channel audio signal. Each secondary channel can be encoded with a single channel audio encoder 9. Alternatively, a common multi-channel may be used for the secondary channels. This multi-channel audio encoder can use in a possible implementation a waveform coding scheme which is adapted to faithfully encode the waveforms of the secondary channels. In a further alternative embodiment the secondary channel encoder 9 can use a parametric representation of the secondary channels. For instance, a simple coding of the energy time and frequency envelopes of the secondary channels can be employed by the secondary channel encoder 9. In that case the secondary channel decoders 12 can use a characteristic of the secondary channels which are decorrelated to artificially generate the decoded secondary channels.

Figure 2:
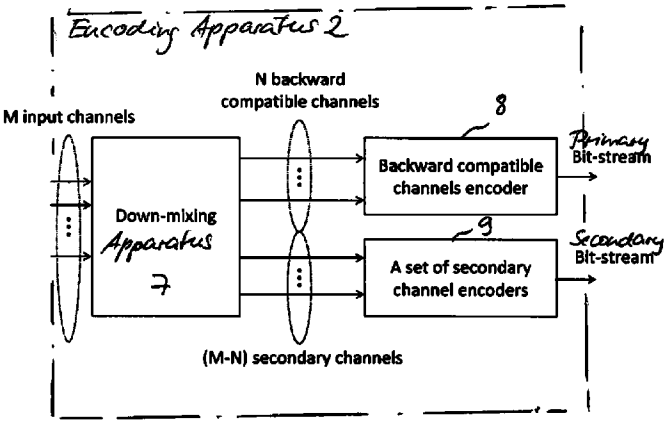
FIG. 2 shows a block diagram for illustrating a possible implementation of a down-mixing apparatus according to the third aspect of the present disclosure.

FIG. 2 illustrates a possible implementation of an encoding apparatus 2 with a down-mixing apparatus 7 according to an aspect of the present disclosure. The down-mixing apparatus 7 receives a multi-channel audio signal comprising a number M of input channels. The down-mixing apparatus 7 comprises a signal adaptive transformation unit which is adapted to perform a signal adaptive transformation of the M input channels by multiplying the input channels with a downmix block matrix. This downmix block matrix can comprise a fixed block to provide a set of backward compatible primary channels and a signal adaptive block to provide a set of secondary channels. The number N of backward compatible primary channels provided by the down-mixing apparatus 7 can be supplied to a corresponding backward compatible channel encoder of the N channels or alternatively to a number N of backward compatible channel encoders 8. The number M-N of the secondary channels can be supplied to a set of secondary channel encoders comprising M-N secondary encoders 9.

Figure 3:
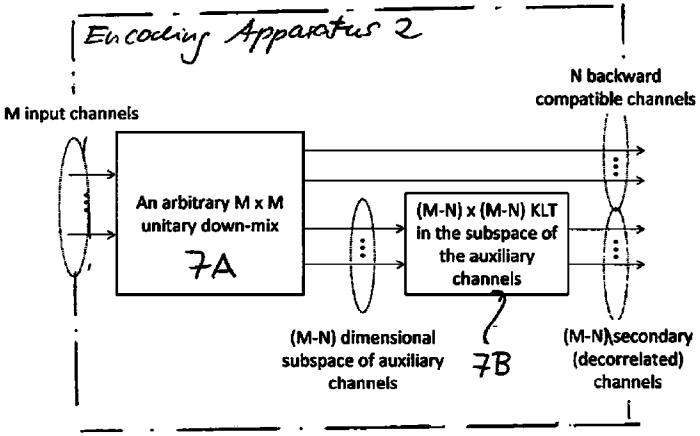
FIG. 3 shows a block diagram of a further possible implementation of a down-mixing apparatus according to the third aspect of the present disclosure.

FIG. 3 shows a further possible implementation of a down-mixing apparatus 7. In the shown implementation the down-mixing apparatus 7 comprises an arbitrary M×M unitary down-mix block 7A. The signal adaptive transformation of the number M of input channels is performed by multiplying the input channels with a downmix block matrix to provide a set of backward compatible primary channels and a set of auxiliary channels. To the set of auxiliary channels a Karhunen-Loeve-transformation KLT is applied in block 7B to provide the set of secondary channels.

In the following the downmix operation is described with reference to an illustrative example. In this exemplary example the number M of input channels is M=3 and the number N of backward compatible primary channels is N=1. Accordingly, the multi-channel audio signal is performed in this example by a three-channel audio signal.

A method for performing an adaptive down-mixing of a multi-channel audio signal comprising a number M of input channels, wherein a signal adaptive transformation of said input channels is performed by multiplying the input channels with a downmix block matrix $W^T$ comprising a fixed block $W_O$ for providing a set N of backward compatible primary channels and a signal adaptive block $W_x$ for providing a set M-N of secondary channels.

The samples of the three-channel input signal can be represented by a random vector X with a realization $x \in \mathbb{R}$. The signal can be divided into blocks, so that it can be viewed as stationary and, therefore, for each such block, an inter-channel covariance matrix $\Sigma_X = \mathbb{E}\{XX^T\}$ can be estimated for instance by computing a sample inter-channel covariance matrix. In a case with no backward compatibility constraint, the down-mixing method can lead to the maximum energy concentration in the channels of the down-mix signal. The energy concentration can be evaluated, for example, by computing a coding gain. If the energy concentration is large, the corresponding coding gain is large. The large coding gain indicates efficiency of source coding and thus facilitates coding of the primary and secondary channels of the down-mix. The optimal energy concentrating transform diagonalizes $\Sigma_X$, i.e., the covariance matrix can be decomposed as $\Sigma_X = U\Lambda U^T$, where U is a unitary transform (i.e., $UU^T = I$) and A is a diagonal matrix. In this case the transform $U^T$ forms the KLT matrix and yields a diagonal covariance matrix, since $\Lambda = U^T \Sigma_X U$. If the KLT matrix is used to generate the down-mix, the corresponding vector sample of the down-mix signal Y is then computed as:

$$\underbrace{\begin{bmatrix} y_0 \\ y_1 \\ y_2 \end{bmatrix}}_{Y} = \underbrace{\begin{bmatrix} \vec{u}_0^T \\ \vec{u}_1^T \\ \vec{u}_2^T \end{bmatrix}}_{U^T} \underbrace{\begin{bmatrix} x_0 \\ x_1 \\ x_2 \end{bmatrix}}_{X}. \tag{1}$$

The estimate of the inter-channel covariance matrix $\Sigma_X$ is updated on a frame-by-frame basis, which implies that the optimal transform $U^T$ varies in time. If for example $y_0$ is a sample of a mono down-mix and because $y_0 = \vec{u}_0^T x_0$, the relation to the original signal X is not fixed in time, it may happen that the perceptual quality of the down-mix is time-varying (in particular due to the modeling errors in this case). The vectors $\vec{u}_0^T, \ldots, \vec{u}_2^T$ form a basis in the $\mathbb{R}^3$ space that is optimized based on the signal statistics.

Figure 4:
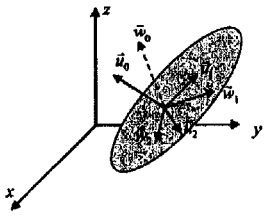
FIG. 4 shows a diagram for illustrating an exemplary backward compatible downmix performed by a down-mixing apparatus according to an aspect of the present disclosure.

In a possible implementation to achieve a good quality of the down-mix signal one can construct a basis that contains some fixed vectors, which may be used to obtain down-mix channels with stable quality (primary channels), and some non-fixed vectors that can exploit the statistics of the signal and provide the optimal over-all energy concentration. Such a scenario is presented in FIG. 4. In the unconstrained case the basis is given by $\vec{u}_0^T, \ldots \vec{u}_2^T$. The goal is to find another basis, $\vec{w}_0^T, \ldots, \vec{w}_2^T$, where the vector $\vec{w}_0^T$ is arbitrarily fixed. The down-mix signal can be then obtained as $y_0=\vec{w}_0^T x_0$, which yields a down-mix signal with a stable quality. This approach may be generalized to the case of an N-channel down-mix, where N orthonormal vectors may be arbitrary chosen yielding a N-channel down-mix that has stable spatial properties.

i. One can define a suitable criterion for designing a transform according to an implementation of the present disclosure. A reasonable criterion is the coding gain that may be maximized by improving the energy concentration. If the transform is given by matrix W, an inter-channel covariance matrix of the transformed signal is given by $\Sigma_Y=W\Sigma_X W^T$. In general, matrix W is not the KLT matrix, and the inter-channel covariance matrix $\Sigma_Y$ is not diagonal. However, since the transform matrix W is constrained to be unitary, one can use the diagonal elements of $\Sigma_Y$, given by $\sigma_{Y_0}^2, \ldots, \sigma_{Y_{M-1}}^2$, to measure the performance of the energy concentration. The coding gain G is defined as $$G=\frac{\frac{1}{M}\sum_{m=0}^{M-1}\sigma_{Y_m}^2}{\left(\sum_{m=0}^{M-1}\sigma_{Y_m}^2\right)^{\frac{1}{M}}}. \tag{2}$$

ii. In fact the numerator of (2) does not depend on the specific unitary transform that is used. This can be easily seen since $\mathrm{Tr}\{W\Sigma_Y W^T\}=\mathrm{Tr}\{WW^T\Sigma_Y\}=\mathrm{Tr}\{\Sigma_Y\}$. Therefore the coding gain G is maximized if the denominator of (2) is minimized.

iii. For encoding of a multichannel signal represented by a source of X generating samples with $x\in\mathbb{R}^M$, an estimate of the inter-channel covariance matrix $\Sigma_X=\mathbb{E}\{XX^T\}$ is available. The goal is to find a transformation matrix W such that the coding gain G given by equation (2) is maximized, with a constraint on some vectors in W. One can therefore consider an orthonormal transform $$W=[W_0|W_X], \tag{3}$$

where $W_0\in\mathbb{R}^{M\times N}$ contains N orthonormal vectors that are selected according to any arbitrary method that results in the stable quality of the down-mix. The other block of W that is of form of matrix $W_X\in\mathbb{R}^{M\times(M-N)}$ which contains M−N remaining basis vectors that are adapted to obtain optimal energy concentration for a given covariance matrix $\Sigma_X$. The design problem is to determine the optimal $W_X$ given the constrained part of the transform specified in $W_0$.

To provide an algorithm for finding $W_X$, it is possible to introduce an auxiliary orthonormal transform V $$V=[W_0|V_X], \tag{4}$$

where $V_X\in\mathbb{R}^{M\times(M-N)}$ is chosen arbitrarily, so that $VV^T=I$. Since the orthonormal transform V must be unitary, the columns of $W_0$ and $V_X$ must be orthonormal. Several procedures exist that generate $V_X$ satisfying this requirement. For instance, one of these procedures involves a Gram-Schmidt procedure initialized with the basis vectors in $W_0$ and applied to any vector in $\mathbb{R}^M$.

For the covariance matrix of the transformed signal $\Sigma_Y$ $$\sum_Y = W^T\sum_X W \tag{5}$$

$$= W^T VV^T\sum_X VV^T W, \tag{6}$$

one can use the fact that V is unitary. By introducing V additional structure is imposed into the design problem. One has therefore $$\sum_Y = \underbrace{\begin{bmatrix} I_{N\times N} & 0_{N\times(M-N)} \\ 0_{(M-N)\times N} & W_X^T V_X \end{bmatrix}}_{W^T V} \underbrace{V^T\sum_X V}_{\Sigma_V} \underbrace{\begin{bmatrix} I_{N\times N} & 0_{N\times(M-N)} \\ 0_{(M-N)\times N} & W_X^T V_X \end{bmatrix}}_{V^T W}, \tag{7}$$

where the structure with the off-diagonal zero matrices is due to the fact that the columns of $V_X$ are orthonormal to $W_0$. It can be shown that the coding gain G in equation (2) is maximized if $W_X^T V_X$ is chosen to be the KLT of a corresponding block matrix within $\Sigma_V$. Let $\Sigma_V$ be of the following form $$\sum_V = \begin{bmatrix} [\sum_V]^A_{N\times N} & [\sum_V]^C_{N\times(M-N)} \\ [\sum_V]^B_{(M-N)\times N} & [\sum_V]^D_{(M-N)\times(M-N)} \end{bmatrix}. \tag{8}$$

Because $Q\in\square^{(M-N)\times(M-N)}$ is an orthonormal transform that diagonalizes $[\Sigma_V]^D_{(M-N)\times(M-N)}$ the matrix Q may be found by means of a KLT performed over a block of $[\Sigma_V]^D_{(M-N)\times(M-N)}$. Since V and $\Sigma_X$ are known, the optimal block $W_X$ of the transform W is given by $$W_X=(V_V^T Q)^T. \tag{9}$$

iv. The proposed method can be implemented very efficiently as shown in FIG. 3. The process of generating the primary and the secondary channels may be performed in two stages. The first stage 7A comprises applying a unitary transformation to the multichannel signal by means of an M×M unitary matrix. The transformation results in N primary channels and M−N auxiliary channels. The second stage 7B involves computation of the KLT in the sub-space of the auxiliary channels. The KLT transforms the auxiliary channels into secondary channels that are coded. The first transformation in stage 7A can be pre-computed. The KLT may be obtained by transforming an inter-channel covariance matrix by means of the first transformation and by selecting a block corresponding to the auxiliary channels.

Figure 6:
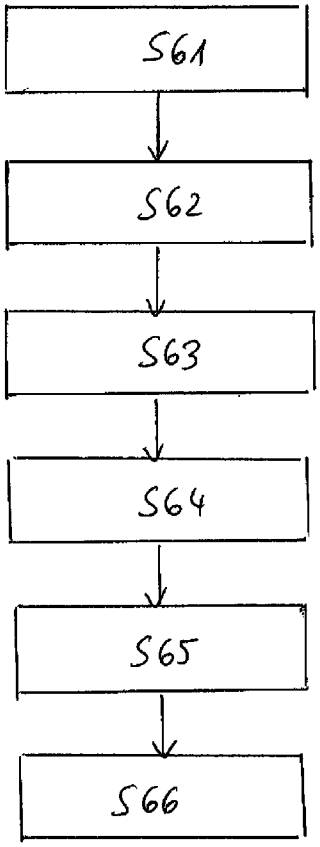
FIGS. 6 and 7 show flowcharts of exemplary implementations of an encoding method according to an aspect of the present disclosure.

The inter-channel covariance matrix $\Sigma_X$ of the input M channel signal can be available by means of estimation or transmitted as side information. The proposed method for generating the backward compatible down-mix $W^T=[W_0|W_X]^T$ or up-mix $W=[W_0|W_X]$ including N backward compatible primary channels from the input signal including M channels comprises the following encoding steps as shown in FIG. 6.

Obtaining an estimate of the inter-channel covariance $E_X$ in step S61.

Choosing a predefined constrained part of the down-mixing transformation $W_0$ in step S62.

Computing an arbitrary M×M transformation V that includes the block $W_0$ in step S63.

Computing an auxiliary covariance matrix $V^T\Sigma_X V$ in step S64.

Computing the KLT matrix Q for a block $[\Sigma_V]_{(M-N)\times(M-N)}^{D}$ (see eq. (8)) of the auxiliary covariance matrix in step S65.

Computing the block $W_X$ according to the equation (9) in step S66.

Figure 7:
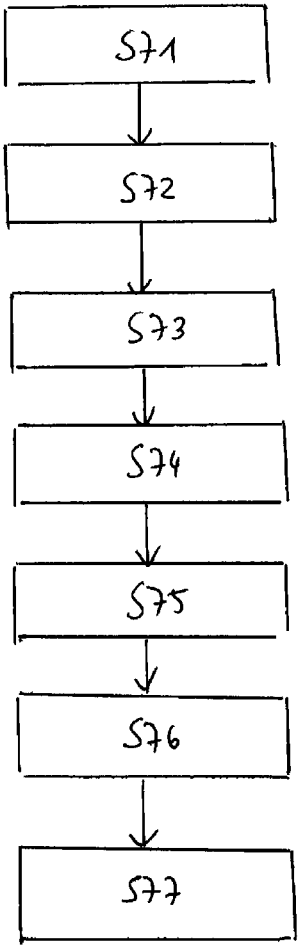

According to some implementations an encoding algorithm can be implemented as shown in FIG. 7:

Obtaining an estimate of the inter-channel covariance $\Sigma_X$ in step S71.

Choosing a predefined constrained part of the down-mixing transformation $W_0$ in step S72.

Computing an arbitrary M×M transformation V that includes the block $W_0$ in step S73.

Generating in step S74 a set of N primary channels and a set of M−N auxiliary channels by means of the transformation obtained in Step S73.

Computing the inter-channel covariance matrix for the subspace of the auxiliary channels based on known V and $\Sigma_X$ in step S75.

Computing in step S76 KLT for the subspace of the auxiliary channels based on the inter-channel covariance matrix obtained in Step S75.

Transforming in step S77 the auxiliary channels computed in Step S74 by means of the KLT computed in Step S76 that yields a set of M−N auxiliary channels.

Figure 8:
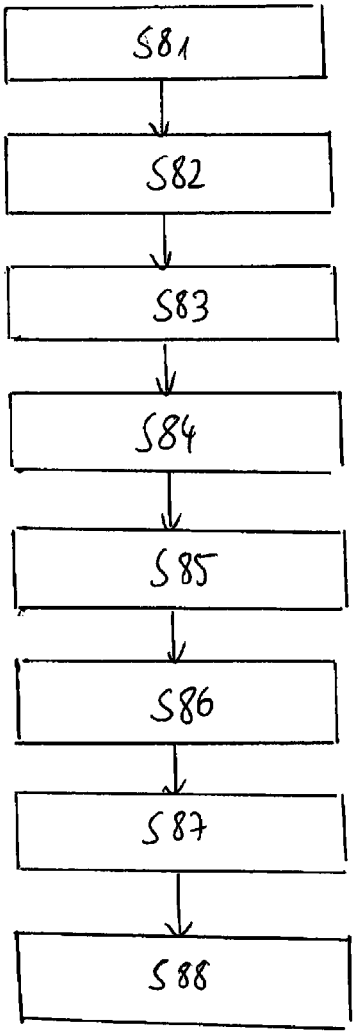
FIG. 8 shows a flowchart of an exemplary embodiment of a decoding method according to an aspect of the present disclosure.

According to a possible implementation the decoding method can be implemented as shown in FIG. 8:

Obtaining in step S81 an estimate of the inter-channel covariance matrix $\Sigma_X$ that was transmitted as side information.

Choosing in step S82 a predefined constrained part of the down-mixing transformation $W_0$ to be the same as the constrained part used in the down-mixing procedure.

Computing in a step S83 an inverse M×M transformation that includes the block $W_0$ Decoding in a step S84 a bit-stream representing a set of N primary channels and M−N secondary channels and performing their reconstruction.

Computing in step S85 the inter-channel covariance matrix for the subspace of the auxiliary channels. This step S85 is possible since $\Sigma_X$ and the transformation obtained in the Step S82 are known.

Computing in step S86 the inverse KLT for the subspace of the auxiliary channels based on the inter-channel covariance matrix obtained in Step S85.

Transforming in step S87 the secondary channels reconstructed in Step S84 by means of the inverse KLT computed in Step S85 that yields a set of M−N auxiliary channels.

Computing in step S88 an up-mix using a transformation computed in Step S83 and the reconstructed primary channels obtained in Step S83 and the reconstructed auxiliary channels obtained in Step S87.

Figure 5:
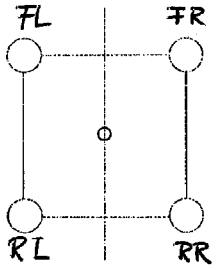
FIG. 5 shows a diagram for illustrating an exemplary implementation of an audio system according to the seventh aspect of the present disclosure.

The application of the method according to the present disclosure can be illustrated by a numerical example in the case of quadrophonic sound. For a play-out setup as shown in FIG. 5, the speaker setup consists of four speakers: front left (FL), front right (FR), rear left (RL) and rear right (RR). The goal is to find an adaptive down-mixing method that facilitates coding efficiency and provides a backward compatible stereo down-mix. In this case a reasonable stereo down-mix is obtained by averaging the FR and the RR channels that yields a new right channel (R). The left channel (L) of the stereo down-mix is obtained by averaging the FL and RL channels. In this case the constrained part of the down-mixing matrix comprises two vectors $$\frac{1}{2}[\sqrt{2}\quad\sqrt{2}\quad 0\quad 0]^T$$

and $$\frac{1}{2}[0\quad 0\quad\sqrt{2}\quad\sqrt{2}]^T.$$

After selecting these vectors a first step of the encoding algorithm is completed. We assumed that the original input channels are provided in the following order FL, RL, FR, RL. In this example, we assume that the inter-channel covariance matrix $\Sigma_X$ for the considered signal has the form $$\sum_X = \begin{bmatrix} 0.6645 & 0.5991 & 0.7705 & 0.4253 \\ 0.5991 & 0.8824 & 1.1504 & 0.2444 \\ 0.7705 & 1.1504 & 2.0479 & 0.3622 \\ 0.4253 & 0.2444 & 0.3622 & 0.3707 \end{bmatrix} \tag{10}$$

Since the constrained part of the transformation is known the unconstrained part can be computed using the Gram-Schmidt procedure. The down-mix can look like the one given in (11).

$$V^T = \begin{bmatrix} 0 & 0 & 0.7071 & 0.7071 \\ 0.7071 & 0.7071 & 0 & 0 \\ -0.1623 & 0.1623 & -0.6882 & 0.6882 \\ 0.6882 & -0.6882 & -0.1623 & 0.1623 \end{bmatrix} \tag{11}$$

The covariance matrix $V^T\Sigma_X V$ can be easily computed. A 2×2 block of the covariance matrix is of form $$[\sum_V]_{2\times 2}^{D} = \begin{bmatrix} 0.6818 & 0.4011 \\ 0.4011 & 0.3351 \end{bmatrix}. \tag{12}$$

The KLT of $[\Sigma_V]_{2\times 2}^{D}$ takes the form $$Q = \begin{bmatrix} 0.8322 & -0.5544 \\ 0.5544 & 0.8322 \end{bmatrix}. \tag{13}$$

The adapted part $W_x$ of the transformation matrix w can be computed from (9) yielding:

$$W_X = \begin{bmatrix} 0.2408 & -0.2408 & -0.6648 & 0.6648 \\ 0.6648 & -0.6648 & 0.2408 & -0.2408 \end{bmatrix}^T. \tag{14}$$

The final transformation for the down-mix $W^T$ takes the form:

$$W^T = \begin{bmatrix} 0 & 0 & 0.7071 & 0.7071 \\ 0.7071 & 0.7071 & 0 & 0 \\ 0.2408 & -0.2408 & -0.6648 & 0.6648 \\ 0.6648 & -0.6648 & 0.2408 & -0.2408 \end{bmatrix}. \quad (15)$$

The down-mix matrix given by (11) is provides a non-adaptive down-mixing method that provides a backward compatible stereo down-mix. The performance of such a down-mix evaluated by means of the coding gain G is 8.0. In the considered example, the proposed down-mixing method resulting in the backward-compatible down-mixing $W^T$ matrix given by equation (15) yields the coding gain of 26.6 which is a substantial improvement compared to the non-adaptive down-mixing method. One can verify the inter-channel covariance after applying the transformation (15), which is as follows:

$$W^T \sum_X W = \begin{bmatrix} 1.5715 & 1.2953 & -0.8223 & 0.1920 \\ 1.2953 & 1.3725 & -0.6253 & 0.1106 \\ -0.8223 & -0.6253 & 0.9486 & 0.0000 \\ 0.1920 & 0.1106 & 0.0000 & 0.0728 \end{bmatrix}. \quad (16)$$

It can be seen from (16) that the secondary channels have been mutually decorrelated.

In a possible embodiment in the case when the number of channels is large, the coding efficiency can be improved by using a signal adaptive downmix based on the Karhunen-Loeve-transformation KLT. The method according to the present disclosure facilitates a generation of the signal adaptive downmix that provides backward compatible downmix channels.

The method according to the present disclosure can be used in particular, when a downmix generates a set of backward compatible primary channels and a set of secondary channels. The method according to the present disclosure can be used for coding scenarios where the number of channels is large and where the number of backward compatible primary channels is low.

Depending on certain implementation requirements of the inventive methods, the inventive methods can be implemented in hardware or in software or in any combination thereof.

The implementations can be performed using a digital storage medium, in particular a floppy disc, CD, DVD or Blu-Ray disc, a ROM, a PROM, an EPROM, an EEPROM or a Flash memory having electronically readable control signals stored thereon which cooperate or are capable of cooperating with a programmable computer system such that an embodiment of at least one of the inventive methods is performed.

A further embodiment of the present disclosure is or comprises, therefore, a computer program product with a program code stored on a machine-readable carrier, the program code being operative for performing at least one of the inventive methods when the computer program product runs on a computer.

In other words, embodiments of the inventive methods are or comprise, therefore, a computer program having a program code for performing at least one of the inventive methods when the computer program runs on a computer, on a processor or the like.

A further embodiment of the present disclosure is or comprises, therefore, a machine-readable digital storage medium, comprising, stored thereon, the computer program operative for performing at least one of the inventive methods when the computer program product runs on a computer, on a processor or the like.

A further embodiment of the present disclosure is or comprises, therefore, a data stream or a sequence of signals representing the computer program operative for performing at least one of the inventive methods when the computer program product runs on a computer, on a processor or the like.

A further embodiment of the present disclosure is or comprises, therefore, a computer, processor or any other programmable logic device adapted to perform at least one of the inventive methods.

A further embodiment of the present disclosure is or comprises, therefore, a computer, processor or any other programmable logic device having stored thereon the computer program operative for performing at least one of the inventive methods when the computer program product runs on the computer, processor or the any other programmable logic device, e.g. a FPGA (Field Programmable Gate Array) or an ASIC (Application Specific Integrated Circuit).

While the aforegoing was particularly shown and described with reference to particular embodiments thereof, it is to be understood by those skilled in the art that various other changes in the form and details may be made, without departing from the spirit and scope thereof. It is therefore to be understood that various changes may be made in adapting to different embodiments without departing from the broader concept disclosed herein and comprehended by the claims that follow.

What is claimed:

1. A method for performing an adaptive down-mixing of a multi-channel audio signal comprising a number of input channels, the method comprising:

multiplying the input channels and a fixed block to provide a set of backward compatible primary channels that enable backward compatibility of the multi-channel audio signal; and multiplying the input channels and a signal adaptive block to provide a set of secondary channels that enable preserving spatial characteristics of the multi-channel signal;

wherein the fixed and signal adaptive blocks are part of a downmix block matrix and the signal adaptive block depends on an interchannel covariance of said input channels and includes an auxiliary covariance matrix determined by an orthonormal transform.

2. The method according to claim 1, wherein the orthonormal transform is calculated on the basis of the fixed block as initialization of a Gram-Schmidt procedure.

3. The method according to claim 1, wherein a Karhunen-Loeve-transformation (KLT) matrix Q is calculated for a block of the auxiliary covariance matrix.

4. The method according to claim 3, wherein the signal adaptive block of the downmix block matrix is calculated on the basis of the KLT-matrix Q.

5. The method according to claim 1, wherein the backward compatible primary channels are encoded by a single legacy encoder or by a corresponding number of legacy encoders to generate backward compatible primary legacy bit stream, and wherein the secondary channels are encoded by a common multi-channel encoder or by a corresponding number of secondary channel encoders to generate a secondary bit stream for the respective secondary channel.

6. The method according to claim 5, wherein the primary bit streams are transmitted along with the secondary bit streams to remote decoders comprising a single legacy decoder or a corresponding number of legacy decoders adapted to decode the backward compatible primary bit streams for reconstructing the primary channels, and a single secondary channel decoder or a corresponding number of secondary channel decoders adapted to decode the secondary bit streams for reconstructing the secondary channels.

7. The method according to claim 6, wherein a type of a bit stream is signaled to said remote decoders, wherein the signaling of the type is performed by implicit signaling by means of auxiliary data transported in at least one bit stream or by explicit signaling by means of a flag indicating the type of the respective bit stream.

8. The method according to claim 1, wherein a signal adaptive transformation of the number of input channels is performed by multiplying the input channels with said downmix block matrix to provide the set of backward compatible primary channels and a set of auxiliary channels, wherein to the set of auxiliary channels a Karhunen-Loeve-transformation is applied to provide said set of secondary channels.

9. A method for performing an adaptive up-mixing of received bit streams, the method comprising:

decoding a backward compatible primary bit stream; and secondary bit stream;

multiplying the backward compatible primary bit stream with a fixed block to reconstruct a corresponding primary channel;

multiplying a secondary bit stream with a signal adaptive block to reconstruct a corresponding secondary channel; and reconstructing a multi-channel audio signal comprising the corresponding primary and secondary channels, wherein the fixed and signal adaptive blocks are part of an upmix block matrix, where the signal adaptive block depends on an interchannel covariance of said input channels and includes an auxiliary covariance matrix determined by an orthonormal transform.

10. The method according to claim 9, wherein the signal adaptive block of the upmix block matrix is adapted depending on a decoded interchannel covariance of input channels that were downmixed and encoded in the primary and secondary bit streams.

11. The method according to claim 10, wherein an auxiliary covariance matrix for the interchannel covariance of the input channels is decoded.

12. The method according to claim 11, wherein an auxiliary orthonormal inverse transform is calculated on the basis of a fixed block as initialization of a Gram-Schmidt procedure.

13. The method according to claim 11, wherein a Karhunen-Loeve-transformation matrix (KLT) is calculated for a block of the auxiliary covariance matrix.

14. The method according to claim 13, wherein the signal adaptive block of the upmix block matrix is calculated on the basis of the calculated Karhunen-Loeve-transformation matrix.

15. A down-mixing apparatus adapted to perform an adaptive down-mixing of a multi-channel audio signal comprising a number of input channels, said down-mixing apparatus comprising:

a processor; and a memory coupled to the processor, wherein the processor comprises a signal adaptive transformation unit adapted to perform a signal adaptive transformation of said input channels by multiplying the input channels with a downmix block matrix;

the signal adaptive transformation comprising fixed and signal adaptive blocks stored in memory for providing backward compatibility of the multi-channel audio signal through a set of backward compatible primary channels by multiplying the input channel with the fixed block to provide a set of primary channels, and preserving spatial characteristics of the multi-channel audio signal through a set of secondary channels by multiplying the input channel with the signal adaptive block to provide a set of secondary channels;

wherein the signal adaptive block depends on an interchannel covariance of said input channels and includes an auxiliary covariance matrix determined by an orthonormal transform.

16. An encoding apparatus comprising:

at least one legacy encoder adapted to encode backward compatible channels to generate backward compatible bit streams;

at least one secondary channel encoder adapted to encode secondary channels to generate secondary bit streams; and a down-mixing apparatus adapted to perform an adaptive down-mixing of a multi-channel audio signal comprising a number of input channels and comprising a processor and a memory comprising fixed and signal adaptive blocks coupled to the processor, wherein the processor comprises a signal adaptive transformation unit adapted to perform a signal adaptive transformation of said input channels by multiplying the input channels with a downmix block matrix comprising the fixed and signal adaptive blocks stored in the memory so as to (1) provide backward compatibility of the multi-channel audio signal through a set of backward compatible primary channels obtained by multiplying the input channel with the fixed block; and (2) preserve spatial characteristics of the multi-channel audio signal through a set of secondary channels obtained by multiplying the input channel with the signal adaptive block;

wherein the signal adaptive block depends on an interchannel covariance of said input channels and includes an auxiliary covariance matrix determined by an orthonormal transform.

17. An up-mixing apparatus adapted to perform an adaptive up-mixing of decoded bit streams comprising decoded primary bit streams and decoded secondary bit streams, said up-mixing apparatus comprising:

a processor and a memory coupled to the processor;

wherein the processor comprises a signal adaptive retransformation unit which is adapted to:

perform a signal adaptive inverse transformation of the decoded bit streams by multiplying the decoded bit streams with an upmix block matrix comprising a fixed block and a signal adaptive block stored in the memory;

wherein the signal adaptive block depends on an interchannel covariance of said input channels and includes an auxiliary covariance matrix determined by an orthonormal transform;

reconstruct a primary channel by multiplying the decoded primary bit streams with the fixed block; and reconstruct a secondary channel by multiplying the decoded secondary bit streams with the signal adaptive block.

18. A decoding apparatus comprising:

at least one legacy decoder adapted to decode received backward compatible primary bit streams to generate decoded primary bit streams supplied to an up-mixing apparatus, at least one secondary channel decoder adapted to decode received secondary bit streams to generate decoded secondary bit streams supplied to said up-mixing apparatus, and an up-mixing apparatus adapted to perform an adaptive up-mixing of decoded bit streams comprising the decoded primary bit streams and the decoded secondary bit streams, said up-mixing apparatus comprising a processor and a memory coupled to the processor, wherein the processor comprises a signal adaptive retransformation unit which is adapted to:

perform a signal adaptive inverse transformation of the decoded primary and secondary bit streams by multiplying the decoded primary and secondary bit streams with an upmix block matrix comprising fixed and signal adaptive blocks stored in the memory;

reconstruct a primary channel by multiplying the decoded primary bit streams with the fixed block; and reconstruct a secondary channel by multiplying the decoded secondary bit streams with the signal adaptive block;

wherein the signal adaptive block depends on an interchannel covariance of said input channels and includes an auxiliary covariance matrix determined by an orthonormal transform.

19. The apparatus according to claim 17, wherein the signal adaptive block of the upmix block matrix is adapted depending on a decoded interchannel covariance of input channels that were downmixed and encoded in the primary and secondary bit streams.

20. The apparatus according to claim 18, wherein the signal adaptive block of the upmix block matrix is adapted depending on a decoded interchannel covariance of input channels that were downmixed and encoded in the primary and secondary bit streams.

* * * * *